US012123633B2

(12) United States Patent
Kawano et al.

(10) Patent No.: US 12,123,633 B2
(45) Date of Patent: Oct. 22, 2024

(54) REFRIGERANT SYSTEM

(71) Applicants: DAIKIN INDUSTRIES, LTD., Osaka (JP); DAIKIN EUROPE N.V., Ostend (BE)

(72) Inventors: Satoshi Kawano, Osaka (JP); David Steen, Ostend (BE); Kevin Cornelis, Ostend (BE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 313 days.

(21) Appl. No.: 17/630,308

(22) PCT Filed: Oct. 29, 2020

(86) PCT No.: PCT/JP2020/040619

§ 371 (c)(1),
(2) Date: Jan. 26, 2022

(87) PCT Pub. No.: WO2021/085529

PCT Pub. Date: May 6, 2021

(65) Prior Publication Data

US 2022/0275983 A1 Sep. 1, 2022

(30) Foreign Application Priority Data

Oct. 29, 2019 (EP) ..... 19205883

(51) Int. Cl.
*F25B 41/20* (2021.01)

(52) U.S. Cl.
CPC ..... *F25B 41/20* (2021.01)

(58) Field of Classification Search
CPC ..... F25B 41/20
See application file for complete search history.

(56) References Cited

U.S. PATENT DOCUMENTS

2009/0272135 A1 11/2009 Nishimura et al.
2015/0233622 A1* 8/2015 Yajima ..... F25B 49/005 62/129

(Continued)

FOREIGN PATENT DOCUMENTS

EP 3115714 A1 1/2017
EP 3 521 721 A1 8/2019

(Continued)

OTHER PUBLICATIONS

Gang, Air Conditioner, 2016, Full Document (Year: 2016).*

(Continued)

*Primary Examiner* — Nael N Babaa
(74) *Attorney, Agent, or Firm* — Birch, Stewart, Kolasch & Birch, LLP

(57) ABSTRACT

The present invention aims to alleviate the risk of leakage of refrigerant from a refrigerant circuit and particularly at the utilization side of the refrigerant circuit without the need to provide a dedicated bypass for refrigerant leakage prevention. A refrigerant system is configured such that, when a refrigerant leakage detection sensor detects refrigerant leakage, a controller is configured to adjust a opening degree of a bypass expansion valve independently of a pressure and/or temperature value detected by a sensor. A method of controlling a refrigerant system is also provided.

18 Claims, 2 Drawing Sheets

(56) References Cited

U.S. PATENT DOCUMENTS

| | | | |
|---|---|---|---|
| 2019/0338986 | A1 | 11/2019 | Yamada et al. |
| 2020/0011580 | A1 | 1/2020 | Matsuda et al. |
| 2020/0166257 | A1 | 5/2020 | Wada et al. |
| 2020/0240686 | A1 | 7/2020 | Yajima |
| 2020/0248943 | A1 | 8/2020 | Nishio et al. |
| 2020/0271344 | A1 | 8/2020 | Ikeda et al. |

FOREIGN PATENT DOCUMENTS

| | | | | |
|---|---|---|---|---|
| EP | 3543624 | A1 | 9/2019 | |
| JP | 2007-127325 | A | 5/2007 | |
| JP | 2015-75272 | A | 4/2015 | |
| JP | 2018-54237 | A | 4/2018 | |
| JP | 2019-74222 | A | 5/2019 | |
| WO | WO-2018062177 | A1 * | 4/2018 | ..... F24F 3/0525 |
| WO | WO 2018/167820 | A1 | 9/2018 | |
| WO | WO 2019/030885 | A1 | 2/2019 | |
| WO | WO 2019/069422 | A1 | 4/2019 | |
| WO | WO 2019/069423 | A1 | 4/2019 | |

OTHER PUBLICATIONS

International Search Report, issued in PCT/JP2020/040619, PCT/ISA/210, dated Feb. 1, 2021.

Search Report issued in European priority application 19205883.2, dated Apr. 7, 2020.

International Preliminary Report on Patentability and Written Opinion of the International Searching Authority, issued in PCT/JP2020/040619, PCT/IB/326, PCT/IB/373 and PCT/ISA/237, mailed May 12, 2022.

* cited by examiner

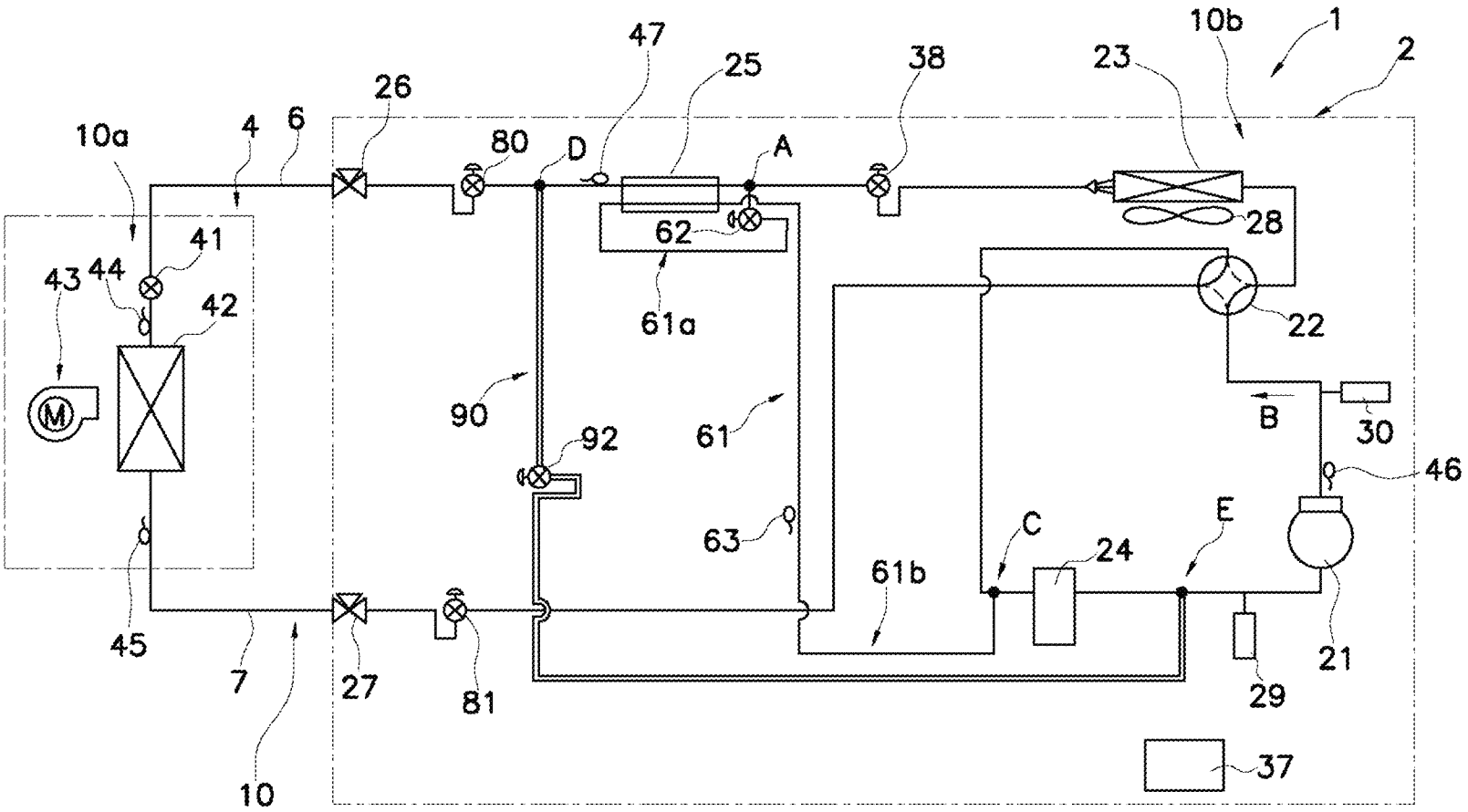
[Fig. 1]

[Fig. 2]
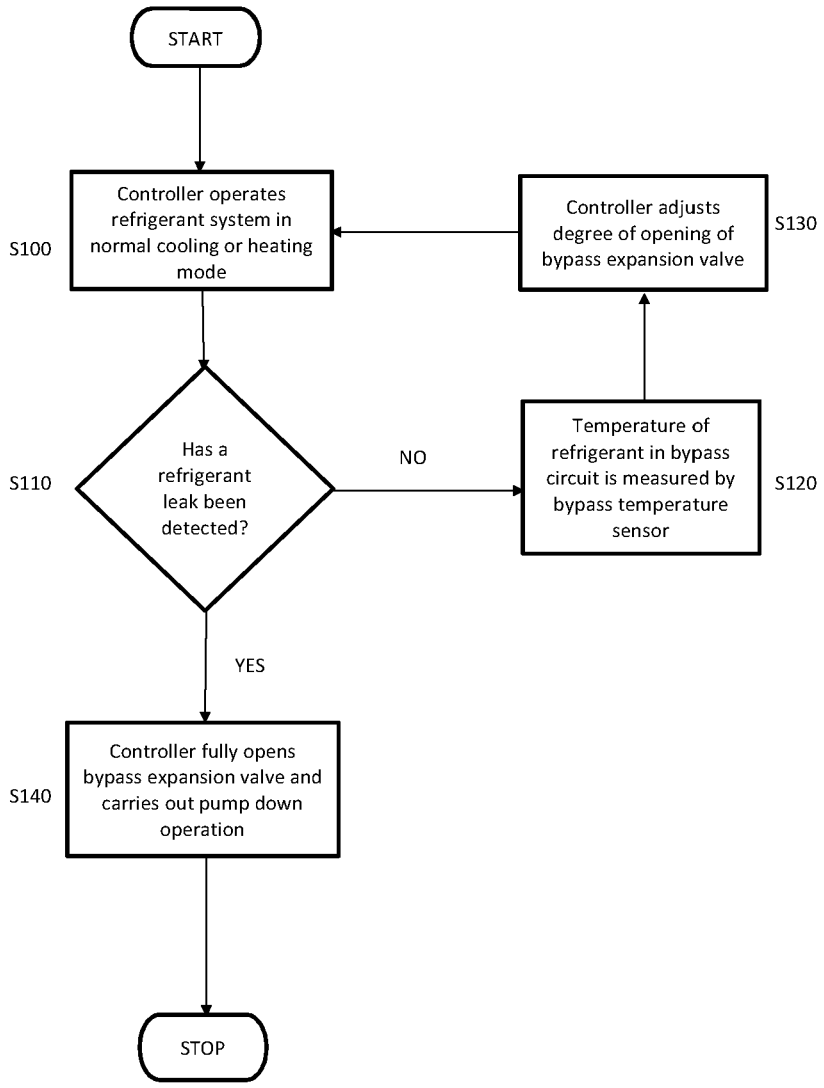

REFRIGERANT SYSTEM

TECHNICAL FIELD

The present invention refers to a refrigerant system including a refrigerant circuit in which a compressor, a heat side source heat exchanger, an expansion mechanism and a utilization side heat exchanger are connected.

BACKGROUND ART

It is desirable to prevent refrigerant from leaking from the refrigerant circuit, and particularly where refrigerant is leaking from the utilization side of the refrigerant circuit. Where the refrigerant circuit is included in, for example, air conditioning apparatus, refrigerant leaking from the utilization side of the refrigerant circuit can reduce the efficiency of the air conditioner as well as leak out into offices or hotel bedrooms, for example, which may damage the affected rooms and is also unpleasant for the people living or working in those rooms. Furthermore, where the refrigerant is flammable, leakage of the refrigerant into an indoor space can result in a serious fire hazard.

In order to attempt to prevent leakage of a refrigerant into a room or other indoor space it has been proposed that, when leakage of a refrigerant is detected, a refrigerant recovery operation is performed on the refrigerant circuit whereby refrigerant is drained from the utilization side to the heat source side and is stored in the heat source side of the refrigerant circuit. Examples of such refrigerant recovery operations can be found in WO2019069423, WO2019069422 and WO2019030885. It has further been proposed that a dedicated bypass to enable storage of refrigerant be provided in the heat source side of the refrigerant circuit. An example of a refrigerant circuit incorporating such a dedicated bypass for refrigerant leakage prevention is shown in EP 3115714.

The present invention aims to alleviate the risk of leakage of refrigerant from a refrigerant circuit and particularly at the utilization side of the refrigerant circuit without the need to provide a dedicated bypass for refrigerant leakage prevention.

SUMMARY OF INVENTION

The present invention provides a refrigerant system comprising:

a refrigerant circuit including a compressor, a heat source side heat exchanger, an expansion mechanism and a utilization side heat exchanger;

a temperature adjustment mechanism configured to adjust the temperature of a refrigerant sent during a cooling operation from the heat source side heat exchanger to the utilization side heat exchanger via the expansion mechanism, the temperature adjustment mechanism being located between the heat source side heat exchanger and the utilization side heat exchanger on the refrigerant circuit;

a bypass refrigerant circuit into which a portion of the refrigerant sent during a cooling operation from the heat source side heat exchanger to the utilization side heat exchanger is branched, the bypass refrigerant circuit comprising a bypass expansion valve for adjusting the flow rate of the branched refrigerant portion, the branched refrigerant portion passing from the bypass expansion valve to the temperature adjustment mechanism to undergo a heat exchange process with the refrigerant sent from the heat source side heat exchanger to the utilization side heat exchanger, the branched refrigerant portion thereafter being returned to a location at the suction side of the compressor; and a sensor configured to detect the temperature and/or pressure of refrigerant in the refrigerant circuit or air temperature external to the refrigerant circuit;

the refrigerant system further comprising a controller configured to control the opening degree of the bypass expansion valve; and a refrigerant leakage detection sensor configured to detect leakage of the refrigerant from the refrigerant circuit;

wherein the controller is configured to adjust the opening degree of the bypass expansion valve as a function of a pressure and/or temperature value detected by the sensor;

and wherein the refrigerant system is configured such that, if the refrigerant leakage detection sensor detects refrigerant leakage, the controller is configured to adjust the opening degree of the bypass expansion valve independently of the pressure and/or temperature value detected by the sensor.

By providing a refrigerant leakage detection sensor and configuring the controller to adjust the opening degree of the bypass expansion valve independently of the pressure and/or temperature value detected by the sensor in the event that the refrigerant leakage detection sensor detects refrigerant leakage, the flow of refrigerant to the utilization side of the refrigerant circuit can be reduced or stopped in the event of a refrigerant leak.

Only one bypass circuit is required in order to provide both the temperature adjustment mechanism and the control of the flow of refrigerant in the refrigerant circuit in the event of a leak, thereby eliminating the need for a dedicated bypass for refrigerant leakage prevention. This simplifies the refrigerant circuit and keeps the size of the refrigerant circuit to a minimum, as well as reducing manufacturing time and cost.

The controller may be configured to fully open the bypass expansion valve in the event that the refrigerant leakage detection sensor detects refrigerant leakage.

The refrigerant system may form part of an air conditioner. The refrigerant system may operate in a cooling mode or in a heating mode. The controller may be configured to control the elements of the refrigerant system such that they operate in a cooling mode or alternatively in a heating mode. The heat source side may be an outdoor side. The utilization side may be an indoor side. The indoor side may be a room in a building, for example. The outdoor side may be outdoors or may alternatively be in an indoor space separated from the utilization side.

The expansion mechanism may be an expansion valve.

The temperature adjustment mechanism may be a subcooler including a heat exchanger. The heat exchanger may be a double tube type heat exchanger. Alternatively the heat exchanger may be a plate type heat exchanger.

The sensor may be a temperature sensor. Alternatively, the sensor may be a pressure sensor. The sensor may be a thermistor. The sensor may be a bypass sensor configured to detect the temperature and/or pressure of the branched refrigerant portion in the bypass refrigerant circuit. The sensor may be a sensor configured to detect the air temperature outside of the refrigerant circuit, such as the ambient temperature of the outdoor air or the temperature of the air in an indoor space to be cooled or heated, for example. The sensor may be a discharge thermistor for measuring the temperature of the refrigerant exiting the compressor. The sensor may be a thermistor configured to measure the temperature of the refrigerant exiting the temperature adjustment mechanism.

The refrigerant system may also include an accumulator for storage of refrigerant. The accumulator may be located on the refrigerant circuit between the location where the branched refrigerant portion is returned to the refrigerant circuit from the bypass refrigerant circuit and the suction side of the compressor.

A first on-off valve may be located on the refrigerant circuit between the temperature adjustment mechanism and the utilization side heat exchanger. The first on-off valve may be located at the heat source side or may alternatively be located at the utilization side. The first on-off valve may be located between the heat source side and the utilization side. The first on-off valve may be openable or closable to allow or prevent refrigerant from passing from a heat source side portion of the refrigerant circuit to a utilization side portion of the refrigerant circuit. The operation of the first on-off valve may be controlled by the controller. The controller may be configured to control the first on-off valve such that, if the refrigerant leakage detection sensor detects refrigerant leakage, the controller is configured to close the first on-off valve to thereby prevent refrigerant from passing from the heat source side portion of the refrigerant circuit to the utilization side portion of the refrigerant circuit.

The first on-off valve may be an expansion valve. The first on-off valve may be a ball valve. The first on-off valve may be a solenoid valve.

The refrigerant leakage detection sensor may be positioned on or within the refrigerant circuit.

The controller may be configured such that the controller activates the compressor in the event that refrigerant leakage is detected.

A second on-off valve may be located on the refrigerant circuit between the utilization side heat exchanger and the location where the branched refrigerant portion is returned to the refrigerant circuit from the bypass refrigerant circuit. The second on-off valve may be located at the heat source side or may alternatively be located at the utilization side. The second on-off valve may be located between the heat source side and the utilization side. The second on-off valve may be openable or closable to allow or prevent refrigerant from passing from a utilization side portion of the refrigerant circuit to a heat source side portion of the refrigerant circuit. The second on-off valve may be an expansion valve. The second on-off valve may be a ball valve. The second on-off valve may be a solenoid valve. The operation of the second on-off valve may be controlled by the controller. The controller may be configured to control the second on-off valve such that, if the refrigerant leakage detection sensor detects refrigerant leakage, the controller is configured to keep open the second on-off valve to thereby allow refrigerant to pass from the utilization side portion of the refrigerant circuit to the heat source side portion of the refrigerant circuit.

The controller may be configured such that if a pressure and/or temperature value detected at the discharge side of the compressor equals or passes a predetermined value, the compressor is deactivated and the second on-off valve is closed. For example, during a pump down operation the pressure on the discharge side of the compressor may increase, and the controller may be configured such that the compressor is deactivated when the pressure detected at the discharge side of the compressor has increased to a predetermined value. During a pump down operation, the temperature on the discharge side of the compressor may increase initially and then decrease to a lower value. A lower temperature value than that seen during normal operation may be set as the predetermined value, and the controller may be configured such that the compressor is deactivated when the temperature detected at the discharge side of the compressor has decreased such that it falls to or below the predetermined value.

The expansion mechanism may comprise an expansion valve located between the first on-off valve and the utilization side heat exchanger. This expansion valve may be utilized when the refrigerant system is operated in a cooling mode.

The expansion mechanism may comprise an expansion valve located between the heat source side heat exchanger and the temperature adjustment mechanism. This expansion valve may be utilized when the refrigerant system is operated in a heating mode.

The expansion mechanism may comprise one or more expansion valves. The expansion valve or valves of the expansion mechanism may be controlled by the controller.

The refrigerant system may comprise a second bypass refrigerant circuit into which a portion of the refrigerant sent during a cooling operation from the temperature adjustment mechanism to the first on-off valve is branched. The second bypass refrigerant circuit may comprise a second bypass valve. The second branched refrigerant portion may be returned to the suction side of the compressor. The second bypass valve may be controlled by the controller. The controller may be configured to fully close the second bypass valve in the event that the refrigerant leakage detection sensor detects refrigerant leakage.

The refrigerant circuit may include a refrigerant. The refrigerant may be flammable.

The controller may comprise one or more control units. If a plurality of control units is provided, one control unit may control the sensors and other apparatus (such as the compressor) of the heat source side and another control unit may control the sensors and other apparatus of the utilization side. The control units may be configured to communicate with each other.

In another embodiment, the present invention provides a method of controlling a refrigerant system including a compressor, a heat source side heat exchanger, an expansion mechanism and a utilization side heat exchanger; the method comprising:

providing a temperature adjustment mechanism configured to adjust the temperature of a refrigerant sent during a cooling operation from the heat source side heat exchanger to the utilization side heat exchanger via the expansion mechanism, the temperature adjustment mechanism being located between the heat source side heat exchanger and the utilization side heat exchanger on the refrigerant circuit;

providing a bypass refrigerant circuit into which a portion of the refrigerant sent during a cooling operation from the heat source side heat exchanger to the utilization side heat exchanger is branched, the bypass refrigerant circuit comprising a bypass expansion valve for adjusting the flow rate of the branched refrigerant portion, the branched refrigerant portion passing from the bypass expansion valve to the temperature adjustment mechanism to undergo a heat exchange process with the refrigerant sent from the heat source side heat exchanger to the utilization side heat exchanger, the branched refrigerant portion thereafter being returned to a location at the suction side of the compressor;

providing a sensor configured to detect the temperature and/or pressure of the refrigerant in the refrigerant circuit or air temperature external to the refrigerant circuit; and providing a controller configured to control the refrigerant system;

wherein, when the controller operates the refrigerant system in a normal cooling mode of operation, the controller adjusts the opening degree of the bypass expansion valve as a function of a pressure and/or temperature value detected by the sensor; and when the controller operates the refrigerant system in a pump down mode of operation, the controller adjusts the opening degree of the bypass expansion valve independently of the pressure and/or temperature value detected by the sensor.

The sensor may be a temperature sensor. Alternatively, the sensor may be a pressure sensor. The sensor may be a thermistor. The sensor may be a bypass sensor configured to detect the temperature and/or pressure of the branched refrigerant portion in the bypass refrigerant circuit. The sensor may a sensor configured to detect the air temperature outside of the refrigerant circuit, such as the ambient temperature of the outdoor air or the temperature of the air in an indoor space to be cooled or heated, for example. The sensor may be a discharge thermistor for measuring the temperature of the refrigerant exiting the compressor. The sensor may be a thermistor configured to measure the temperature of the refrigerant exiting the temperature adjustment mechanism.

When the controller operates the refrigerant system in a pump down mode, the controller may fully open the bypass expansion valve.

The pump down mode may be activated in response to detection of a refrigerant leak from the refrigerant system. A refrigerant leakage detection sensor may be provided and may detect leakage of the refrigerant from the refrigerant circuit. The refrigerant leakage detection sensor may be provided in the indoor unit and may detect leakage of the refrigerant in the indoor unit.

BRIEF DESCRIPTION OF DRAWINGS

FIG. 1 is a schematic configuration view of a refrigerant system according to an embodiment of the present invention.

FIG. 2 is a flowchart showing operational modes of the refrigerant system.

DESCRIPTION OF EMBODIMENTS

A schematic drawing of a refrigerant system in accordance with the present invention is shown in FIG. 1. In this embodiment, the refrigerant system 1 is part of an air conditioner and includes an outdoor unit 2 as a heat source unit and an indoor unit 4 as a utilization unit. A liquid refrigerant pipe 6 and a gas refrigerant pipe 7 connect the outdoor unit and the indoor unit together.

The indoor unit may be installed by being embedded or attached to or hung from a ceiling of a room in a building or by being embedded or mounted to a wall surface or a floor of a room. The indoor unit includes the indoor side 10*a* of the refrigerant circuit 10 and comprises an indoor expansion mechanism in the form of an indoor expansion valve 41 and an indoor heat exchanger 42 as a utilization side heat exchanger. The indoor heat exchanger functions as an evaporator for the refrigerant during a cooling operation to cool the air in the room and functions as a condenser for the refrigerant during a heating operation to heat the air in the room. The indoor unit includes an indoor fan 43 for taking in air from the room into the unit, causing the air to heat exchange with the refrigerant in the indoor heat exchanger and then supplying the cooled/heated air back to the room. A plurality of indoor units may be connected in parallel in order to independently cool or heat several different rooms in the building.

The outdoor unit is installed outside of a building or at least outside of the space which is to be cooled/heated. The outdoor unit includes the outdoor side 10*b* of the refrigerant circuit 10 and includes a compressor 21, a four-way switching valve 22, an outdoor heat exchanger 23 as a heat source side heat exchanger, an outdoor expansion mechanism in the form of an outdoor expansion valve 38, an accumulator 24 and a temperature adjustment mechanism in the form of a subcooler 25. The outdoor unit also includes a liquid side stop valve 26 and a gas side stop valve 27 for permitting or preventing flow of refrigerant between the indoor and outdoor units. The liquid side stop valve and the gas side stop valve may be manually operated valves or may be electronically operated valves. The gas side of the outdoor heat exchanger 23 is connected to the four-way switching valve 22 and the liquid side of the outdoor heat exchanger 23 is connected to the liquid refrigerant pipe 6.

The refrigerant circuit also includes a first on-off valve 80 and a second on-off valve 81 for permitting or preventing flow of refrigerant between the indoor and outdoor units. The first and second on-off valves may be electronically operated valves and may be controlled by the controller.

The four-way switching valve 22 is a valve for switching the direction of flow of the refrigerant such that, during the cooling operation, the four-way switching valve 22 is capable of connecting a discharge side of the compressor 21 and a gas side of the outdoor heat exchanger 23 and connecting a suction side of the compressor 21 and the gas refrigerant pipe 7 (see the solid lines of the four-way switching valve 22 in FIG. 1) to cause the outdoor heat exchanger 23 to function as a condenser for the refrigerant compressed by compressor 21 and to cause the indoor heat exchanger 42 to function as an evaporator for the refrigerant condensed in the outdoor heat exchanger 23. During the heating operation the four-way switching valve 22 is capable of connecting the discharge side of the compressor 21 and the gas refrigerant pipe 7 and connecting the suction side of the compressor 21 and the gas side of the outdoor heat exchanger 23 (see the dotted lines of the four-way switching valve 22 in FIG. 1) to cause the indoor heat exchanger 42 to function as a condenser for the refrigerant compressed by compressor 21 and to cause the outdoor heat exchanger 23 to function as an evaporator for the refrigerant condensed in the indoor heat exchanger 42.

The outdoor unit includes an outdoor fan 28 for taking in outdoor air into the unit, causing the air to exchange heat with the refrigerant in the outdoor heat exchanger 23 and then exhausting the air to the outside.

The accumulator 24 is connected between the four-way switching valve 22 and the compressor 21 and is a container capable of accumulating excess refrigerant generated in the refrigerant circuit 10 in accordance with the change in the operation load of the indoor unit 4.

The subcooler 25 may be a double tube heat exchanger and is disposed to cool the refrigerant sent to the indoor expansion valve 41 after the refrigerant is condensed in the outdoor heat exchanger 23. In this example, the subcooler 25 is connected between the outdoor expansion valve 38 and the liquid side stop valve 26. A bypass refrigerant circuit 61 is the cooling source of the subcooler 25. In the description below, for convenience and ease of understanding, a portion corresponding to the refrigerant circuit 10 excluding the bypass refrigerant circuit 61 is referred to a main refrigerant circuit. In this embodiment, the bypass refrigerant circuit 61 is connected to the main refrigerant circuit so as to cause a portion of the refrigerant sent from the outdoor heat exchanger 23 to the indoor expansion valve 41 to branch from the main refrigerant circuit and return to the suction side of the compressor 21. The bypass refrigerant circuit includes a branch circuit 61*a* connected so as to branch a portion of the refrigerant sent from the outdoor expansion valve 38 to the indoor expansion valve 41 at a position A between the outdoor heat exchanger 23 and the subcooler 25, and a merging circuit 61*b* connected to the suction side of the compressor 21 so as to return a portion of refrigerant from an outlet on a bypass refrigerant circuit side of the subcooler 25 to the suction side of the compressor 21. The branch circuit 61*a* is provided with a bypass expansion valve 62 for adjusting the flow rate of the refrigerant flowing in the bypass refrigerant circuit 61. The bypass expansion valve 62 may comprise an electrically operated expansion valve. The refrigerant sent from the outdoor heat exchanger 23 to the indoor expansion valve 41 is cooled in the subcooler 25 by the refrigerant flowing in the bypass refrigerant circuit which has been depressurized by the bypass expansion valve 62. Performance of the subcooler can be controlled by adjusting the opening degree of the bypass expansion valve 62.

The merging circuit 61*b* of the bypass refrigerant circuit 61 includes a bypass temperature sensor 63 for detecting the temperature of the refrigerant flowing through the outlet on the bypass refrigerant circuit side of the subcooler 25. The bypass temperature sensor 63 may be a thermistor.

Various sensors may be provided in both the indoor and outdoor units. In this example, a suction pressure sensor 29 that detects a suction pressure Ps of the compressor 21 is provided in the outdoor unit, as well as a discharge pressure sensor 30 that detects a discharge pressure Pd of the compressor 21. In this example, the indoor unit is provided with a liquid side temperature sensor 44 that detects the temperature of the refrigerant (e.g., the refrigerant temperature corresponding to an evaporation temperature Te during the cooling operation) at the liquid side of the indoor heat exchanger 42, and is also provided with a gas side temperature sensor 45 that detects a temperature Teo of the refrigerant at a gas side of the indoor heat exchanger 42. The temperature sensors 44 and 45 may be thermistors. The outdoor unit may be provided with a discharge temperature sensor 46 that detects the temperature of the refrigerant at the outlet of the compressor, and may also be provided with a subcool temperature sensor 47 that detects the temperature of the refrigerant at the outlet of the subcooler 25. The temperature sensors 46 and 47 may be thermistors.

A controller 37 is also provided and is connected so as to be able to receive signals from the various sensors including the bypass temperature sensor 63 and also to be able to control the bypass expansion valve 62 and the first and second on-off valves 80, 81.

During the cooling operation the refrigerant flows in the direction indicated by arrow B and the four-way switching valve 22 is in the state represented by the solid lines in FIG. 1. The outdoor expansion valve 38 is in a fully opened state. The liquid side stop valve 26 and the gas side stop valve 27 are in an opened state. The first on-off valve 80 and the second on-off valve 81 are in an opened state. The opening degree of the indoor expansion valve 41 is adjusted such that a superheat degree SHr of the refrigerant at the outlet of the indoor heat exchanger 42 (i.e., the gas side of the indoor heat exchanger 42) becomes constant at a target superheat degree SHrs. The superheat degree SHr of the refrigerant at the outlet of the indoor heat exchanger 42 can be detected by subtracting the refrigerant temperature (which corresponds to the evaporation temperature Te) detected by the liquid side temperature sensor 44 from the refrigerant temperature detected by the gas side temperature sensor 45 or can be detected by converting the suction pressure Ps of the compressor 21 detected by the suction pressure sensor 29 to saturated temperature corresponding to the evaporation temperature Te, and subtracting this saturated temperature of the refrigerant from the refrigerant temperature detected by the gas side temperature sensor 45. Note that, although it is not used in this embodiment, a temperature sensor that detects the temperature of the refrigerant flowing through the indoor heat exchanger 42 may be provided such that the superheat degree SHr of the refrigerant at the outlet of the indoor heat exchanger 42 is detected by subtracting the refrigerant temperature corresponding to the evaporation temperature Te which is detected by this temperature sensor from the refrigerant temperature detected by the gas side temperature sensor 45. In addition, the opening degree of the bypass expansion valve 62 is adjusted such that a superheat degree SHb of the refrigerant at the outlet on the bypass refrigerant circuit side of the subcooler 25 becomes a target superheat degree SHbs. In this example, the superheat degree SHb of the refrigerant at the outlet on the bypass refrigerant circuit side of the subcooler 25 is detected by converting the suction pressure Ps of the compressor 21 detected by the suction pressure sensor 29 to saturated temperature corresponding to the evaporation temperature Te, and subtracting this saturated temperature of the refrigerant from the refrigerant temperature detected by the bypass temperature sensor 63. Note that, although it is not used in this embodiment, a temperature sensor may be disposed at an inlet on the bypass refrigerant circuit side of the subcooler 25 such that the superheat degree SHb of the refrigerant at the outlet on the bypass refrigerant circuit side of the subcooler 25 is detected by subtracting the refrigerant temperature detected by this temperature sensor from the refrigerant temperature detected by the bypass temperature sensor 63.

When the compressor 21, the outdoor fan 28 and the indoor fan 43 are started in this state of the refrigerant circuit 10, low-pressure gas refrigerant is sucked into the compressor 21 and compressed into high-pressure gas refrigerant.

Subsequently, the high-pressure gas refrigerant is sent to the outdoor heat exchanger 23 via the four-way switching valve 22, exchanges heat with the outdoor air supplied by the outdoor fan 28, and becomes condensed into high-pressure liquid refrigerant. Then this high-pressure liquid refrigerant passes through the outdoor expansion valve 38, flows into the subcooler 25, exchanges heat with the refrigerant flowing in the bypass refrigerant circuit 61, is further cooled, and becomes subcooled. At this time, a portion of the high-pressure liquid refrigerant condensed in the outdoor heat exchanger 23 is branched into the bypass refrigerant circuit 61 and is depressurized by the bypass expansion valve 62. Subsequently, it is returned to the suction side of the compressor 21 at position C as shown on FIG. 1. Here, the refrigerant that passes through the bypass expansion valve 62 is depressurized close to the suction pressure Ps of the compressor 21 and thereby a portion of the refrigerant evaporates. Then, the refrigerant flowing from the outlet of the bypass expansion valve 62 of the bypass refrigerant circuit 61 toward the suction side of the compressor 21 passes through the subcooler 25 and exchanges heat with high-pressure liquid refrigerant sent from the outdoor heat exchanger 23 on the main refrigerant circuit side to the indoor unit 4.

Then the high-pressure liquid refrigerant that has become subcooled is sent to the indoor unit 4 via the liquid side stop valve 26 and the liquid refrigerant communication pipe 6. The high-pressure liquid refrigerant sent to the indoor unit 4 is depressurized close to the suction pressure Ps of the compressor 21 by the indoor expansion valve 41, becomes refrigerant in a low-pressure gas-liquid two-phase state, is sent to the indoor heat exchanger 42, exchanges heat with the room air in the indoor heat exchanger 42, and is evaporated into low-pressure gas refrigerant.

This low-pressure gas refrigerant is sent to the outdoor unit 2 via the gas refrigerant communication pipe 7 and flows into the accumulator 24 via the gas side stop valve 27 and the four-way switching valve 22. Then the low-pressure gas refrigerant that flowed into the accumulator 24 is again sucked into the compressor 21.

During the heating operation, the four-way switching valve 22 is in a state represented by the dotted lines in FIG. 1, i.e., a state where the discharge side of the compressor 21 is connected to the gas sides of the indoor heat exchanger 42 via the gas side stop valve 27 and the gas refrigerant communication pipe 7 and also the suction side of the compressor 21 is connected to the gas side of the outdoor heat exchanger 23. The opening degree of the outdoor expansion valve 38 is adjusted so as to be able to depressurize the refrigerant that flows into the outdoor heat exchanger 23 to a pressure where the refrigerant can evaporate (i.e., evaporation pressure Pe) in the outdoor heat exchanger 23. In addition, the liquid side stop valve 26, the gas side stop valve 27, the first on-off valve 80 and the second on-off valve 81 are in an opened state. The opening degree of the indoor expansion valve 41 is adjusted such that a subcooling degree SCr of the refrigerant at the outlet of the indoor heat exchanger 42 becomes constant at the target subcooling degree SCrs. In this embodiment, a subcooling degree SCr of the refrigerant at the outlets of the indoor heat exchanger 42 is detected by converting the discharge pressure Pd of the compressor 21 detected by the discharge pressure sensor 30 to saturated temperature corresponding to the condensation temperature Tc, and subtracting the refrigerant temperature detected by the liquid side temperature sensor 44 from this saturated temperature of the refrigerant. Note that, although it is not used in this embodiment, a temperature sensor that detects the temperature of the refrigerant flowing through the indoor heat exchanger 42 may be disposed such that the subcooling degree SCr of the refrigerant at the outlets of the indoor heat exchanger 42 is detected by subtracting the refrigerant temperature corresponding to the condensation temperature Tc which is detected by this temperature sensor from the refrigerant temperature detected by the liquid side temperature sensor 44. In addition, the bypass expansion valve 62 may be closed.

When the compressor 21, the outdoor fan 28 and the indoor fan 43 are started in this state of the refrigerant circuit 10, low-pressure gas refrigerant is sucked into the compressor 21, compressed into high-pressure gas refrigerant, and sent to the indoor unit 4 via the four-way switching valve 22, the gas side stop valve 27, and the gas refrigerant communication pipe 7. Then the high-pressure gas refrigerant sent to the indoor unit 4 exchanges heat with the room air in the indoor heat exchanger 42 and is condensed into high-pressure liquid refrigerant. Subsequently, it is depressurized according to the opening degree of the indoor expansion valve 41 when passing through the indoor expansion valve 41. The refrigerant that passed through the indoor expansion valve 41 is sent to the outdoor unit 2 via the liquid refrigerant communication pipe 6, is further depressurized via the liquid side stop valve 26, the subcooler 25, and the outdoor expansion valve 38, and then flows into the outdoor heat exchanger 23. Then, the refrigerant in a low-pressure gas-liquid two-phase state that flowed into the outdoor heat exchanger 23 exchanges heat with the outdoor air supplied by the outdoor fan 28, is evaporated into low-pressure gas refrigerant, and flows into the accumulator 24 via the four-way switching valve 22. Then, the low-pressure gas refrigerant that flowed into the accumulator 24 is again sucked into the compressor 21.

The cooling and heating operations as described above are controlled by the controller 37.

The refrigerant system includes a refrigerant leakage detection sensor. Each indoor unit may be provided with a refrigerant leakage detection sensor. The refrigerant leakage detection sensor notifies the controller if leakage of refrigerant is detected. Where a plurality of indoor units each having their own refrigerant leakage detection sensor is provided, the controller is configured to establish which of the indoor units is leaking refrigerant. The refrigerant leakage detection sensor may comprise a single sensor or may comprise several sensors whose cumulative data is used to establish whether or not refrigerant is leaking. The controller may additionally or alternatively use data from sensors located on the refrigerant circuit to establish whether there is a refrigerant leak in the refrigerant circuit.

In normal operation, the controller adjusts the opening degree of the bypass expansion valve 62 as a function of the refrigerant temperature detected by the bypass temperature sensor 63 as explained above. However, in the event that the refrigerant leakage detection sensor detects a refrigerant leak, the controller is configured to carry out a pump down operation. In a pump down operation, the controller is configured to fully open the bypass expansion valve 62 regardless of the refrigerant temperature detected by the bypass temperature sensor 63. Furthermore, in a pump down operation the controller is also configured to close the first on-off valve 80 to prevent refrigerant from flowing from the outdoor unit to the indoor unit, to activate the compressor and to keep the second on-off valve 81 open to allow refrigerant to flow from the indoor unit to the outdoor unit. Thereby, during the pump down operation, refrigerant from the indoor unit can flow to the outdoor unit, and no refrigerant should flow from the outdoor unit to the indoor unit. This prevents leakage of refrigerant from the indoor unit. Once the temperature and/or pressure of the refrigerant at the discharge side of the compressor is below a predetermined value, the controller deactivates the compressor and closes the second on-off valve. Where an accumulator is present, the refrigerant in the outdoor unit will flow into the accumulator either along the refrigerant main circuit from the second on-off valve to the accumulator or along the bypass circuit to the accumulator where the refrigerant can be stored. If no accumulator is provided, the refrigerant may be stored in the outdoor unit heat exchanger. Although in this example the first on-off valve 80 and the second on-off valve 81 are shown as being located within the outdoor unit, the first on-off valve 80 and the second on-off valve 81 may instead be located within the indoor unit or between the indoor and outdoor units.

Similarly, during a scheduled pump down operation (for example when an indoor unit needs to undergo maintenance or be removed or repaired) the controller disregards the temperature data from the bypass temperature sensor 63 and instead adjusts the bypass extension valve 62 to a fully open position. The four-way valve is switched to a cooling operation mode and the first on-off valve is closed and the second on-off valve is kept open. In this configuration, refrigerant from the indoor unit flows to the outdoor unit, and no refrigerant flows from the outdoor unit to the indoor unit. Once the refrigerant has been drained from the indoor unit to the outdoor unit, the second on-off valve can be closed and the indoor unit can be removed or repaired.

The refrigerant system may optionally include a second bypass refrigerant circuit 90. The second bypass refrigerant circuit 90, when present, may be connected to the main refrigerant circuit so as to cause a portion of the refrigerant sent from the subcooler 25 towards the indoor expansion valve 41 to branch from the main refrigerant circuit and return to the suction side of the compressor 21. The second bypass refrigerant circuit 90 may branch from the main circuit at a position between the subcooler 25 and the first on-off valve, for example at position D in FIG. 1. Alternatively the second bypass circuit may branch from the main circuit at a position between the outdoor expansion valve 38 and the subcooler 25. For example, the second bypass circuit may branch from the main circuit at the same location as the first bypass circuit. The second bypass refrigerant circuit may, where an accumulator is present in the refrigerant system, return to the main circuit at a location between the accumulator and the suction side of the compressor, for example at position E in FIG. 1. The second bypass refrigerant circuit 90 permits subcooled refrigerant to flow from the outlet of the subcooler to the suction side of the compressor, thereby decreasing the discharge superheat of the compressor. The second bypass refrigerant circuit 90 is provided with a second bypass expansion valve 92 for adjusting the flow rate of the refrigerant flowing in the second bypass refrigerant circuit 90. The second bypass expansion valve 92 may comprise an electrically operated expansion valve. Where a second bypass refrigerant circuit is present, the controller is configured to control the second bypass expansion valve 92. In normal operation, the controller adjusts the opening degree of the second bypass expansion valve 92 as a function of the discharge superheat of the compressor. The discharge superheat of the compressor may be measured by, for example, the sensor 46 located at the outlet of the compressor. However, in the event of a pump down operation, the controller is configured to fully close the second bypass expansion valve 92 regardless of the discharge superheat of the compressor. This prevents excess liquid refrigerant from entering the compressor.

FIG. 2 shows a flowchart detailing the operation of the refrigerant system of FIG. 1. In step S100, the controller operates the refrigerant system such that it operates in a normal cooling or heating mode. During normal operation, the controller checks whether a leak has been detected or not (step S110). The controller may be informed of a leak, for example, by a refrigerant leakage detection sensor located in the indoor unit. If no leak has been detected, then the controller monitors the temperature of the refrigerant in the bypass circuit as measured by the bypass temperature sensor (step S120) and adjusts the degree of opening of the bypass expansion valve in accordance with the measured temperature (step S130). The controller continues to operate the refrigerant system in the normal mode as described above as long as no refrigerant leak is detected. Once a refrigerant leak is detected, the controller fully opens the bypass expansion valve (step S140) regardless of the temperature of the refrigerant in the bypass circuit and initiates the pump down operation.

While preferred embodiments of the present invention have been described with reference to the Figures, the scope of the present invention is not limited to the above embodiments and it will be understood that various additions, modifications and substitutions may be made without departing from the scope of the present invention. The presently disclosed embodiments are therefore to be considered in all respects as illustrative and not restrictive, the scope of the invention being indicated by the appended claims, and not limited to the foregoing description.

For example, in the above described embodiment, the present invention is applied to a refrigerant system for an air conditioner capable of switching and performing a cooling operation and a heating operation. However, the present invention is not limited to air conditioners which are capable of carrying out both cooling and heating functions. The present invention may be utilized in cooling only air conditioners for example, or indeed in apparatus other than air conditioners. Furthermore, the present invention may be applied to refrigerant systems wherein a plurality of outdoor units and/or a plurality of indoor units are provided.

REFERENCE SIGNS LIST

1 refrigerant system
2 outdoor unit
4 indoor unit
6 liquid refrigerant pipe
7 gas refrigerant pipe
10 refrigerant circuit
21 compressor
22 four-way switching valve
23 outdoor heat exchanger
24 accumulator
25 subcooler
26 liquid side stop valve
28 outdoor fan
29 suction pressure sensor
30 discharge pressure sensor
37 controller
38 outdoor expansion valve
41 indoor expansion valve
42 indoor heat exchanger
43 indoor fan
44 liquid side temperature sensor
45 gas side temperature sensor
46 discharge temperature sensor
47 subcool temperature sensor
61 bypass refrigerant circuit
62 bypass expansion valve
63 bypass temperature sensor
80 first on-off valve
81 second on-off valve
90 second bypass refrigerant circuit

CITATION LIST

Patent Literature

[PATENT LITERATURE 1] WO2019069423
[PATENT LITERATURE 2] WO2019069422
[PATENT LITERATURE 3] WO2019030885
[PATENT LITERATURE 4] EP 3115714

The invention claimed is:

1. A refrigerant system comprising:

a refrigerant circuit including a compressor, a heat source side heat exchanger, an expansion mechanism and a utilization side heat exchanger;

a temperature adjustment mechanism configured to adjust the temperature of a refrigerant sent during a cooling operation from the heat source side heat exchanger to the utilization side heat exchanger via the expansion mechanism, the temperature adjustment mechanism being located between the heat source side heat exchanger and the utilization side heat exchanger on the refrigerant circuit;

a bypass refrigerant circuit into which a portion of the refrigerant sent during a cooling operation from the heat source side heat exchanger to the utilization side heat exchanger is branched, the bypass refrigerant circuit comprising a bypass expansion valve for adjusting the flow rate of the branched refrigerant portion, the branched refrigerant portion passing from the bypass expansion valve to the temperature adjustment mechanism to undergo a heat exchange process with the refrigerant sent from the heat source side heat exchanger to the utilization side heat exchanger, the branched refrigerant portion thereafter being returned to a location at the suction side of the compressor; and a sensor configured to detect the temperature and/or pressure of the refrigerant in the refrigerant circuit or air temperature external to the refrigerant circuit;

a first on-off valve located on the refrigerant circuit between the temperature adjustment mechanism and the utilization side heat exchanger;

a second bypass refrigerant circuit into which a portion of the refrigerant sent during a cooling operation from the temperature adjustment mechanism to the first on-off valve is branched, the second bypass refrigerant circuit comprising a second bypass valve, and the second branched refrigerant portion being returned to the suction side of the compressor;

the refrigerant system further comprising a controller configured to control the opening degree of the bypass expansion valve; and a refrigerant leakage detection sensor configured to detect leakage of the refrigerant from the refrigerant circuit;

wherein the controller is configured to adjust the opening degree of the bypass expansion valve as a function of a pressure and/or temperature value detected by the sensor;

wherein the refrigerant system is configured such that, when the refrigerant leakage detection sensor detects refrigerant leakage, the controller is configured to adjust the opening degree of the bypass expansion valve independently of the pressure and/or temperature value detected by the sensor and close the second bypass valve.

2. The refrigerant system as claimed in claim 1, wherein the temperature adjustment mechanism is a subcooler including a subcool heat exchanger.

3. The refrigerant system as claimed in claim 1, further comprising an accumulator located on the refrigerant circuit between the location where the branched refrigerant portion is returned to the refrigerant circuit from the bypass refrigerant circuit and the suction side of the compressor.

4. The refrigerant system as claimed in claim 1, wherein the first on-off valve is positioned at a heat source side portion of the refrigerant circuit and is openable or closable to allow or prevent fluid from passing from a heat source side portion of the refrigerant circuit to a utilization side portion of the refrigerant circuit.

5. The refrigerant system as claimed in claim 4, wherein the controller is configured to control the first on-off valve such that, when the refrigerant leakage detection sensor detects refrigerant leakage, said controller is configured to close the first on-off valve to thereby prevent fluid from passing from the heat source side portion of the refrigerant circuit to the utilization side portion of the refrigerant circuit.

6. The refrigerant system as claimed in claim 5, wherein the controller is configured such that when the first on-off valve is closed due to refrigerant leakage being detected, the compressor is activated.

7. The refrigerant system as claimed in claim 6, wherein the refrigerant system further comprises a second on-off valve located on the refrigerant circuit between the utilization side heat exchanger and the location where the branched refrigerant portion is returned to the refrigerant circuit from the bypass refrigerant circuit.

8. The refrigerant system as claimed in claim 7, wherein the controller is configured such that when a pressure and/or temperature value detected at the discharge side of the compressor is below a predetermined value, the compressor is deactivated and the second on-off valve is closed.

9. The refrigerant system as claimed in claim 1, wherein the first and second on-off valves comprise any of the group consisting of an expansion valve, a ball valve or a solenoid valve.

10. The refrigerant system as claimed in claim 1, wherein the expansion mechanism comprises an expansion valve located between the first on-off valve and the utilization side heat exchanger.

11. The refrigerant system as claimed in claim 1, wherein the expansion mechanism comprises an expansion valve located between the heat source side heat exchanger and the temperature adjustment mechanism.

12. The refrigerant system as claimed in claim 1, further comprising a flammable refrigerant.

13. A method of controlling a refrigerant system including a compressor, a heat source side heat exchanger, an expansion mechanism and a utilization side heat exchanger; the method comprising:

providing a temperature adjustment mechanism configured to adjust the temperature of a refrigerant sent during a cooling operation from the heat source side heat exchanger to the utilization side heat exchanger via the expansion mechanism, the temperature adjustment mechanism being located between the heat source side heat exchanger and the utilization side heat exchanger on the refrigerant circuit;

providing a bypass refrigerant circuit into which a portion of the refrigerant sent during a cooling operation from the heat source side heat exchanger to the utilization side heat exchanger is branched, the bypass refrigerant circuit comprising a bypass expansion valve for adjusting the flow rate of the branched refrigerant portion, the branched refrigerant portion passing from the bypass expansion valve to the temperature adjustment mechanism to undergo a heat exchange process with the refrigerant sent from the heat source side heat exchanger to the utilization side heat exchanger, the branched refrigerant portion thereafter being returned to a location at the suction side of the compressor;

providing a sensor configured to detect the temperature and/or pressure of the refrigerant in the refrigerant circuit;

providing a first on-off valve located on the refrigerant circuit between the temperature adjustment mechanism and the utilization side heat exchanger;

providing a second bypass refrigerant circuit into which a portion of the refrigerant sent during a cooling operation from the temperature adjustment mechanism to the first on-off valve is branched, the second bypass refrigerant circuit comprising a second bypass valve, and the second branched refrigerant portion being returned to the suction side of the compressor; and providing a controller configured to control the refrigerant system;

wherein, when the controller operates the refrigerant system in a normal cooling mode of operation, the controller adjusts the opening degree of the bypass expansion valve as a function of a pressure and/or temperature value detected by the sensor; and when the controller operates the refrigerant system in a pump down mode of operation, the controller adjusts the opening degree of the bypass expansion valve independently of the pressure and/or temperature value detected by the sensor and close the second bypass valve.

14. The refrigerant system as claimed in claim 2, further comprising an accumulator located on the refrigerant circuit between the location where the branched refrigerant portion is returned to the refrigerant circuit from the bypass refrigerant circuit and the suction side of the compressor.

15. The refrigerant system as claimed in claim 2, further comprising a first on-off valve located on the refrigerant circuit between the temperature adjustment mechanism and the utilization side heat exchanger.

16. The refrigerant system as claimed in claim 3, further comprising a first on-off valve located on the refrigerant circuit between the temperature adjustment mechanism and the utilization side heat exchanger.

17. The refrigerant system as claimed in claim 4, wherein the first and second on-off valves comprise any of the group consisting of an expansion valve, a ball valve or a solenoid valve.

18. The refrigerant system as claimed in claim 5, wherein the first and second on-off valves comprise any of the group consisting of an expansion valve, a ball valve or a solenoid valve.

* * * * *